US010669072B2

(12) United States Patent
Quinn

(10) Patent No.: US 10,669,072 B2
(45) Date of Patent: Jun. 2, 2020

(54) RETRACTABLE SPOUT FOR A FLOWABLE SUBSTANCE CONTAINER

(71) Applicant: John Quinn, Gorey (IE)

(72) Inventor: John Quinn, Gorey (IE)

( * ) Notice: Subject to any disclaimer, the term of this patent is extended or adjusted under 35 U.S.C. 154(b) by 0 days.

(21) Appl. No.: 16/336,962

(22) PCT Filed: Sep. 28, 2017

(86) PCT No.: PCT/EP2017/074634
§ 371 (c)(1),
(2) Date: Mar. 27, 2019

(87) PCT Pub. No.: WO2018/060335
PCT Pub. Date: Apr. 5, 2018

(65) Prior Publication Data

US 2019/0263566 A1 Aug. 29, 2019

(30) Foreign Application Priority Data

Sep. 28, 2016 (GB) ..... 1616494.9

(51) Int. Cl.
*B65D 25/44* (2006.01)
*B44D 3/12* (2006.01)

(52) U.S. Cl.
CPC ..... *B65D 25/44* (2013.01); *B44D 3/128* (2013.01)

(58) Field of Classification Search
CPC ..... B65D 25/44; B44D 3/128
USPC ..... 222/567, 569, 570, 109
See application file for complete search history.

(56) References Cited

U.S. PATENT DOCUMENTS

| | | | | | |
|---|---|---|---|---|---|
| 2,543,470 | A * | 2/1951 | Ryan | B65D 25/44 | 222/528 |
| 2,765,966 | A * | 10/1956 | Davis | B65D 25/48 | 222/570 |
| 3,463,366 | A * | 8/1969 | Spencer | B65D 25/48 | 222/570 |
| 3,811,606 | A * | 5/1974 | Higgins | B44D 3/128 | 222/570 |
| 3,822,812 | A * | 7/1974 | Shorin | B65D 25/38 | 222/570 |
| 3,899,107 | A * | 8/1975 | Gaal | B44D 3/123 | 222/570 |
| 4,240,568 | A * | 12/1980 | Pool | B44D 3/121 | 220/698 |

(Continued)

FOREIGN PATENT DOCUMENTS

| | | |
|---|---|---|
| AU | 668066 B3 | 4/1996 |
| GB | 2246757 A | 2/1992 |
| GB | 2536505 A | 9/2016 |

OTHER PUBLICATIONS

International Search Report dated Nov. 20, 2017 for PCT/EP2017/074634.

*Primary Examiner* — Donnell A Long
(74) *Attorney, Agent, or Firm* — Burns & Levinson LLP; Jerry Cohen

(57) ABSTRACT

A retractable spout device for a flowable substance container comprising a first section 1 adapted to be secured to an interior of the container, and a second section 2 displaceable relative to the first section in order to facilitate the movement of the second section from a retracted position wherein the second section is at least partially collapsed, to a deployed position wherein the second section extends outwards to form a spout.

27 Claims, 9 Drawing Sheets

(56) References Cited

U.S. PATENT DOCUMENTS

| | | | | |
|---|---|---|---|---|
| 4,907,714 | A * | 3/1990 | Gatz | B44D 3/12 220/698 |
| 5,078,872 | A * | 1/1992 | Durant | B01D 29/085 210/232 |
| 5,269,438 | A * | 12/1993 | Kelsey | B44D 3/12 215/10 |
| 6,253,951 | B1 * | 7/2001 | Pruckler | B44D 3/128 220/359.1 |
| 7,306,118 | B1 | 12/2007 | Korte et al. | |
| 2005/0230440 | A1 | 10/2005 | Gilbertson et al. | |
| 2013/0186918 | A1 * | 7/2013 | Menceles | B65D 41/0407 222/567 |
| 2016/0176589 | A1 * | 6/2016 | Averill | B01F 5/0619 222/190 |

* cited by examiner

RETRACTABLE SPOUT FOR A FLOWABLE SUBSTANCE CONTAINER

CROSS-REFERENCE TO RELATED APPLICATIONS

This application is a U.S. national stage application under 35 U.S.C. 371 of co-pending International Application No. PCT/EP2017/074634, filed Sep. 28, 2017, entitled A RETRACTABLE SPOUT FOR A FLOWABLE SUBSTANCE CONTAINER, which in turn claims priority to Great Britain Patent Application No. 1616494.9, filed Sep. 28, 2016, the contents of which are incorporated by reference herein in their entirety for all purposes.

FIELD OF THE INVENTION

This invention relates to a retractable spout for a flowable substance container such as a paint can or the like in order to facilitate accurate and drip free pouring of a flowable substance from the container, and which spout can be inside about the container in a retracted position when not in use and which does not materially affect the shape and dimensions of the container when in this stored or retracted state.

BACKGROUND OF THE INVENTION

Painting is the most common form of decoration or renovation that is carried out, in particular at the DIY end of the market, with little or no expertise and specialist equipment required in order to successfully complete the task.

However, for non-professional painters, one of the difficulties commonly experienced is in handling the paint itself, for example pouring the paint from the original paint can into a painting tray or smaller container to allow the paint to be handled in practical volume. However, pouring the paint directly from the original paint can often results in a number of difficulties, both in terms of directing the paint being poured into the container or other vessel receiving the paint, in addition to the inevitable drips of paint that run down the outside as the paint can is righted at the end of the pouring process. These drips can often migrate down the full height of the paint can and pool at the lower rim, which can lead to the inadvertent transfer of paint onto any surface onto which the paint can is placed.

There exist numerous devices, whether retro-fittable or directly integrated into the paint can, which attempt to address this issue by providing a spout about the mouth of the can in order to facilitate controlled pouring from the can and to prevent such dripping once pouring has been completed. Most of these devices are not without issues, primarily as the user is required to separately purchase the retro-fittable spout, and once used the spout must then be stored separately to the paint can between uses, and as a result is often difficult to locate when next required. If the spout remains in position on the exterior of the can after use while also allowing the lid of the paint can to be closed, the spout can nevertheless make it difficult to store the can, in particular preventing other cans or the like from being stacked on top of a can having such a spout fixed thereon.

It is therefore an object of the present invention to overcome the above-mentioned problems.

SUMMARY OF THE INVENTION

According to a first aspect of the present invention there is provided a retractable spout device for a flowable substance container comprising a first section adapted to be secured to an interior of the container, and a second section displaceable relative to the first section in order to facilitate the movement of the second section from a retracted position wherein the second section is at least partially collapsed, to a deployed position wherein the second section extends outwards to form a spout.

Preferably, the second section comprises at least one region of increased flexibility relative to the flexibility of the rest of the second section.

Preferably, the at least one region of increased flexibility is centrally disposed on the spout.

Preferably, the at least one region of increased flexibility extends to the pouring edge.

Preferably, the at least one region of increased flexibility is substantially circular.

Preferably, the boundary between the first section and the second section is at least partially defined by a live hinge.

Preferably, the live hinge comprises a line of weakness.

Preferably, the second section comprises a recessed portion along a pouring edge.

Preferably, the pouring edge comprises an apex.

Preferably, the pouring edge includes a protruding beak-like extension.

Preferably, the pouring edge of the second section is inclined towards the radial centre of the container, relative to the interface between the first section and the second section.

Preferably, the first section and second section are flexible.

Preferably, the second section has a shore hardness in the range of A50 to A100, more preferably in the range of A80 to A90, and most preferably A85.

Preferably, the first section has a shore hardness in the range of A5 to A50, more preferably in the range of A20 to A30, and most preferably A25.

Preferably, the retractable spout device comprises multiple layers.

Preferably, different layers define different physical characteristics.

Preferably, at least the outer surface of the second section is formed from a liquid repelling material such as for example a hydrophobic material.

Preferably, at least the outer surface of the second section is formed from a non adherent material.

Preferably, the second section comprises rubber.

Preferably, the first section comprises rubber.

Preferably, the first section is of a substantially elongate rectangular shape.

Preferably, the second section is arranged, in use, to project beyond a mouth of the container when it is in the deployed position.

Preferably, the retractable spout device comprises a drainage channel such that, in use, any excess flowable substance which migrates from the second section to the first section, is returned to the container.

Preferably, the retractable spout device comprises a drainage channel which is provided as part of the first section.

Preferably, the drainage channel extends laterally beyond the second section.

Preferably, first section is adapted to be secured, in use, at any point on an interior surface of the container.

Preferably, the first section is dimensioned to provide, in use, an interference fit with an interior of a sidewall of the container.

Preferably, the first section is adapted to be secured, in use, at any point on the interior surface of the container through means of an adhesive layer.

Preferably, the device further comprises a rigid body exposing at least one edge which is suitable for use as a paint brush scraper.

Preferably, the rigid body is situated adjacent to the second section in order to form a geometric chord across the container.

Preferably, the first section is an annular band with an at least partial interface with the second section.

Preferably, the retractable spout device comprises a resilient spout which is displaceable between the deployed position and the collapsed position.

According to a second aspect of the present invention there is provided a flowable substance container comprising an interior sidewall; a mouth; and a retractable spout; the retractable spout comprising a first section adapted to be secured to an interior of the container, and a second section displaceable relative to the first section in order to facilitate the movement of the second section from a retracted position wherein the second section is at least partially collapsed, to a deployed position wherein the second section extends beyond the mouth to form a spout.

Preferably, the retractable spout is releasably secured to the interior sidewall.

Preferably, the retractable spout is wholly contained within the container when it is in the retracted position.

Preferably, the container comprises a removable or hinged cover to seal the mouth of the container.

Preferably, the retractable spout device is dimensioned to fit, in use, within the space enclosed by the container and the removable or hinged cover

BRIEF DESCRIPTION OF THE DRAWINGS

The present invention will now be described with reference to the accompanying drawings, in which.

DETAILED DESCRIPTION OF THE DRAWINGS

Figure 1:
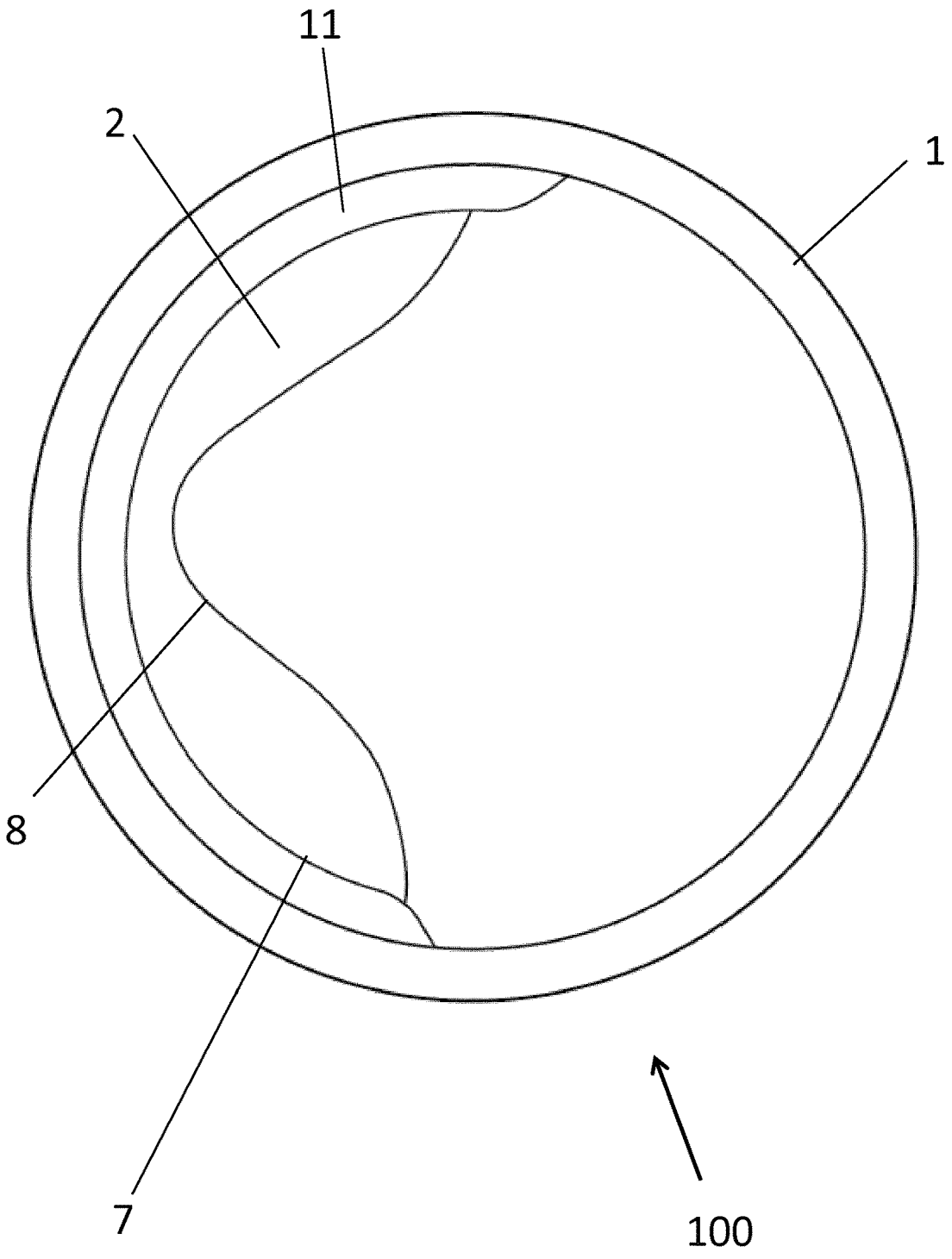
FIG. 1 illustrates a plan elevation of the retractable spout device according to an embodiment of the present invention.
Figure 2:
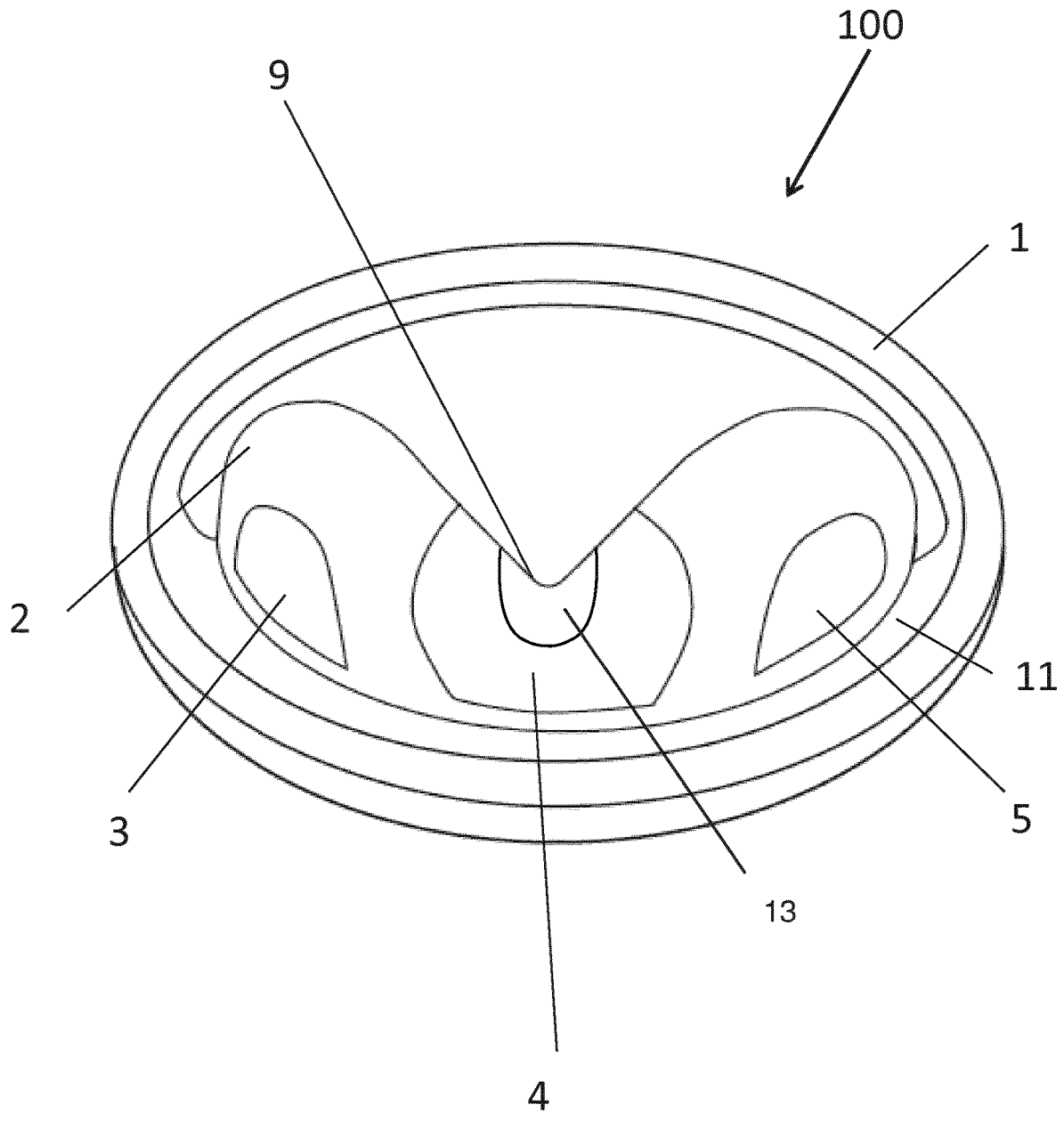
FIG. 2 illustrates a perspective view of the retractable spout device in the deployed position showing regions of increased flexibility.

Referring now to the accompanying drawings there is illustrated a retractable spout device, generally indicated as (100), for use with a flowable substance container, in particular but not exclusively a conventional paint can (C) or the like, although it will be appreciated from the following description that the retractable spout device (100) may be used with any other suitable container from which a flowable substance is to be poured. Further examples of flowable substances could be grain or solid materials in pellet form, however, this list is not exhaustive. The retractable spout device (100) is intended to be secured to or formed integrally with the interior surface of a sidewall (S) of the paint can (C) adjacent an upper rim (R) which defines a mouth of the paint can (C) from which paint is poured, and to be displaceable between a deployed position allowing paint to be poured, and a retracted position when not in use. The retractable spout device (100) is particularly suited to being retrofitted to an existing and unmodified paint can (C) although it could equally be removably applied to or formed integrally with the paint can (C) at the point of manufacture.

The retractable spout device (100) comprises a first section (1) adapted to be secured to an interior of the container (C) as described hereinafter, and a second section (2) connected and displaceable relative to the first section (1), preferably by means of a live hinge (7) which in the embodiment illustrated is in the form of a line of weakness extending across the full width of the second section (2). The live hinge (7), in addition to the resilient deformation of the second section (2), facilitates the displacement of the second section (2) between the deployed and retracted positions as will be described in detail hereinafter.

In a particularly preferred embodiment the first section (1) and the second section (2) are formed from rubber or suitable flexible material, the first section having a shore hardness in the range of A5 to A50, more preferably in the range of A20 to A30, and most preferably approximately A25, the second section preferably having a shore hardness in the range of A50-A100, more preferably in the range of A80 to A90, and most preferably approximately A85, which provides sufficient flexibility to allow the second section (2) to conform to the curved sidewall (S), thereby forming a spout, whilst also providing sufficient rigidity to retain its shape during the pouring of paint. It will be appreciated that one or both sections (1,2) may be formed from a number of layers of material, laminated or otherwise secured together, in order to provide the desired physical and/or aesthetic characteristics such as localised variations in flexibility, surface finish such as hydrophobic surface or non adherent surface, etc. Conversely the first section (1) and/or second section (2) may comprise a single layer having localised physical variations, such as different thickness in different regions, in order to provide the desired physical and/or aesthetic characteristics. This varying single layer could nevertheless be comprised in a laminate of two or more layers. An exemplary material which may be used to at least partially form the device (100) is Santoprene™, a thermoplastic vulcanizate as manufactured by Exxon Mobil Chemical.

Figure 3:
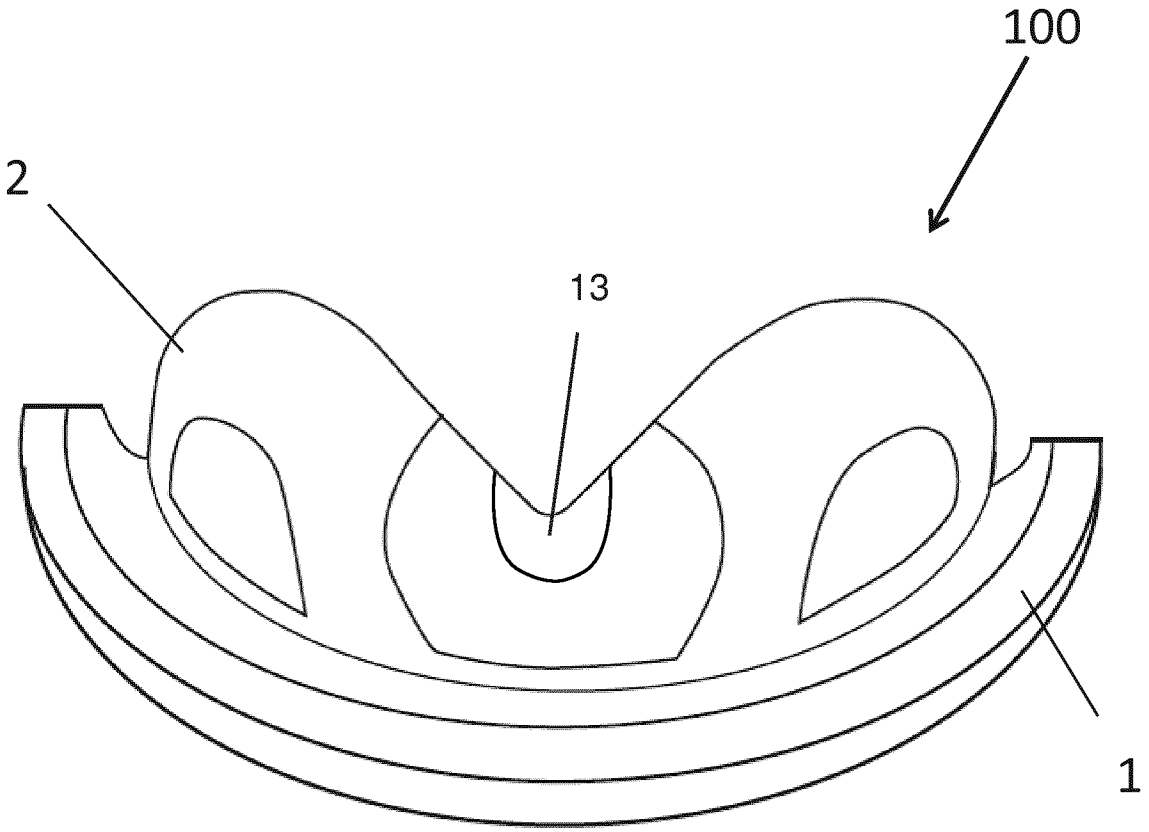
FIG. 3 illustrates a perspective view of the retractable spout device of FIG. 2 wherein the first section is a segment or arc rather than a full annular band.

The first section (1) is preferably of elongate rectangular shape as defined between the live hinge (7) and a lower edge, while the second section (2) is defined between the live hinge (7) and a pouring or upper edge (6). In the preferred embodiment as illustrated in FIG. 1, the first section (1) takes the form of an annular band which is dimensioned to fit the interior radius of the container. The first section (1) may be dimensioned to provide an interference fit with the container (C) or it may be adhered to the inside of the container (C) through an integral adhesive layer or the addition of an external adhesive or any combination of these means. It will be appreciated that the first section (1) need not comprise a full annular band, and could be provided as a segment or arc therefore as shown in FIG. 3, or could be of any other suitable form which enables the spout device (100) to be secured in suitable fashion to an interior surface of the container (C).

Figure 7:
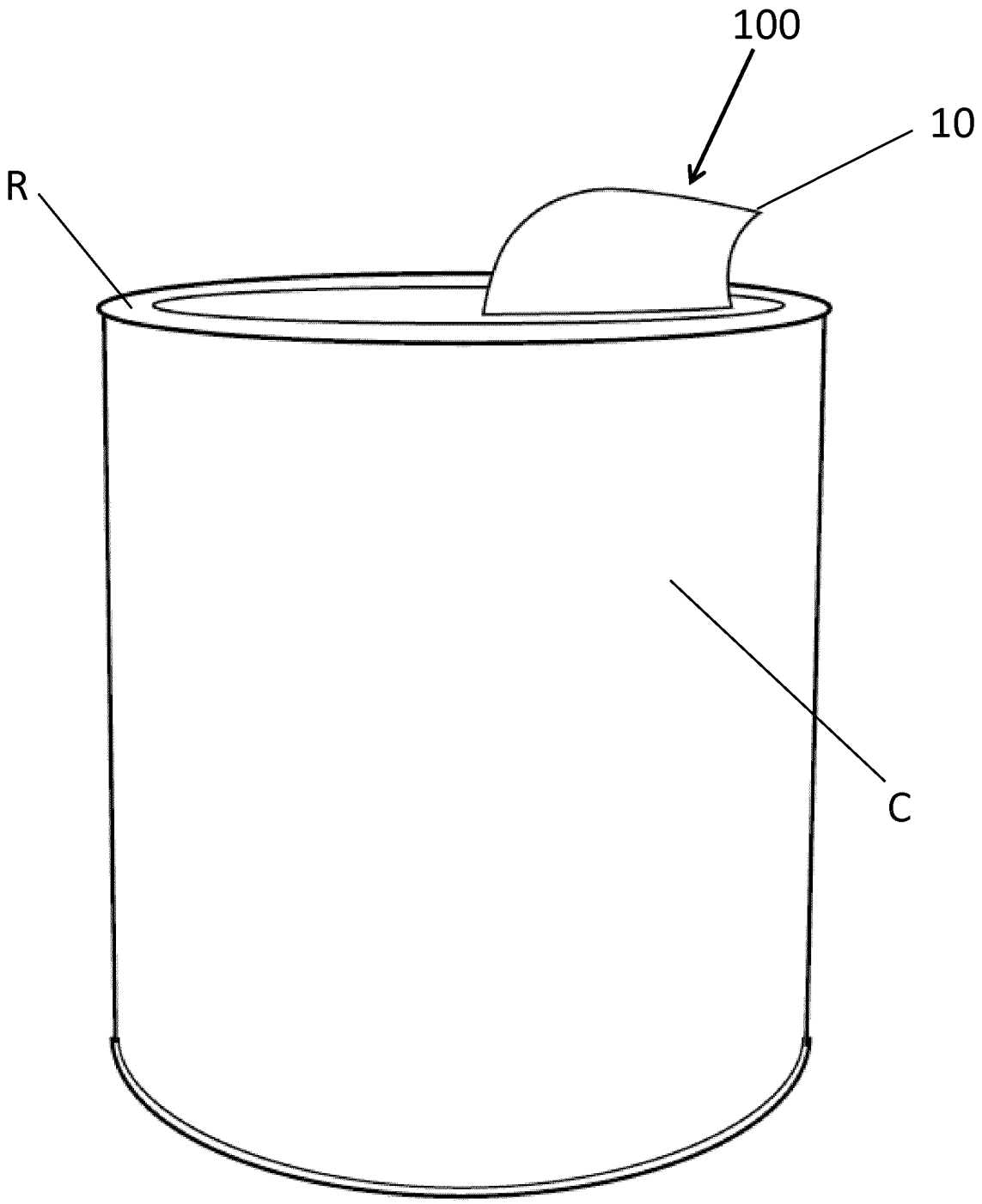
FIG. 7 illustrates a perspective view of the retractable spout device of FIG. 6 with an additional feature comprising a beak like extension on the spout.

The height or depth of the second section (2) may taper inwardly towards the centre such that the pouring edge (6) defines a concave (also referred to as recessed) portion (8) which may terminate at a central apex (9) which, in use, will facilitate a focused or accurate pouring of paint from the spout. The provision of the apex (9) additionally serves to pinch off the flow of paint once the paint can (C) is returned to the upright position, thereby reducing or eliminating drips from forming and running down the outside of the spout and/or the paint can (C). However if drops do run down the outside of the spout, a drainage channel (11) is provided such that any drops which migrate to the bottom of the outside of the spout will flow into the drainage channel (11) and are thus returned to the container (C) as the drainage channel is preferably provided with a gradient running downwardly from the centre towards either outer end of the channel (11). The drainage channel (11) may extend beyond the spout in order to assist the retro-fitting of the device by defining a tab on either side of the second section (2) which may then be gripped or otherwise engaged to permit the first section (1) to be manually or mechanically manipulated for insertion into the container (C). For example this may be performed by suitable equipment such as a robotic arm or the like (not shown) as part of the assembly line production of the empty container (C). The shape of the spout may also be modified to comprise a beak like extension (10) as per FIG. 7, in order to allow more precision in the pouring action and to provide an additional level of clearance from the container (C).

The retractable spout device (100) is designed to be secured to the paint can (C) via the first section (1) which is adhered or otherwise secured beneath the upper rim (R), with the live hinge (7) facing against the interior of the sidewall (S). The live hinge (7) may be substantially coterminous with or slightly below the underside of the upper rim (R), or where no rim is present, the uppermost part of the sidewall of the container (C), or it may be secured at an offset from the upper rim (R) or uppermost part of the sidewall of the container (C). As a result the second section (2), when in the deployed position, projects upwardly beyond the upper rim (R) to form the pouring surface for the liquid exiting the mouth of the paint can (C) during pouring. In the deployed position, both the first section (1) and the second section (2) substantially conform to the curved shape of the interior of the sidewall (S), which provides a natural spout shape to focus the flow of paint towards the concave portion (8) of the second section (2) as it is poured. In addition, the curvature imparted by the shape of the interior of the sidewall (S) increases the stiffness of the second section (2) in order to prevent or minimise deflection or deformation during pouring when a significant volume, and therefore mass, of paint is required to be bourn by the retractable spout device (100). It is appreciated that in a further embodiment wherein the first section (1) is adhered or otherwise secured to a part of the interior surface other than the sidewall (S) of the container, the benefits of substantially conforming to the curved shape of the interior of the sidewall (S) will continue to be realised when the retractable spout device (100) is in the deployed position.

From the deployed position, as illustrated in FIGS. 2, 3, 5, 6, 7 in which the first section (1) is adhered or otherwise secured to the interior of the sidewall (S) directly beneath the upper rim (R), the retractable spout is displaceable into the retracted position in which the second section (2) is folded inward towards the radial centre of the container (C), the provision of the live hinge (7) and the flexibility of the second section (2) permitting this displacement between the two positions. When in the retracted position the second section (2), as a result of the flexibility thereof, is somewhat collapsed in form in order to be effectively stored within the container (C) such that a lid or removable/hinged cover (L) may be placed over the mouth of the container (C) in order to seal the contents of the container (C). In the embodiments where the retractable spout device (100) is permanently fixed to the container (C), due to the resilient nature of the retractable spout device (100), the retractable spout device (100) rests in a position whereby the spout is automatically activated into the deployed position through the removal of such a lid (L). In this way the retractable spout device (100) is immediately available for use when paint is next poured from the paint can (C) without interfering with the normal shape and exterior dimension of the paint can (C) in any way, which means it can be stored and handled as normal in the interim.

Figure 5:
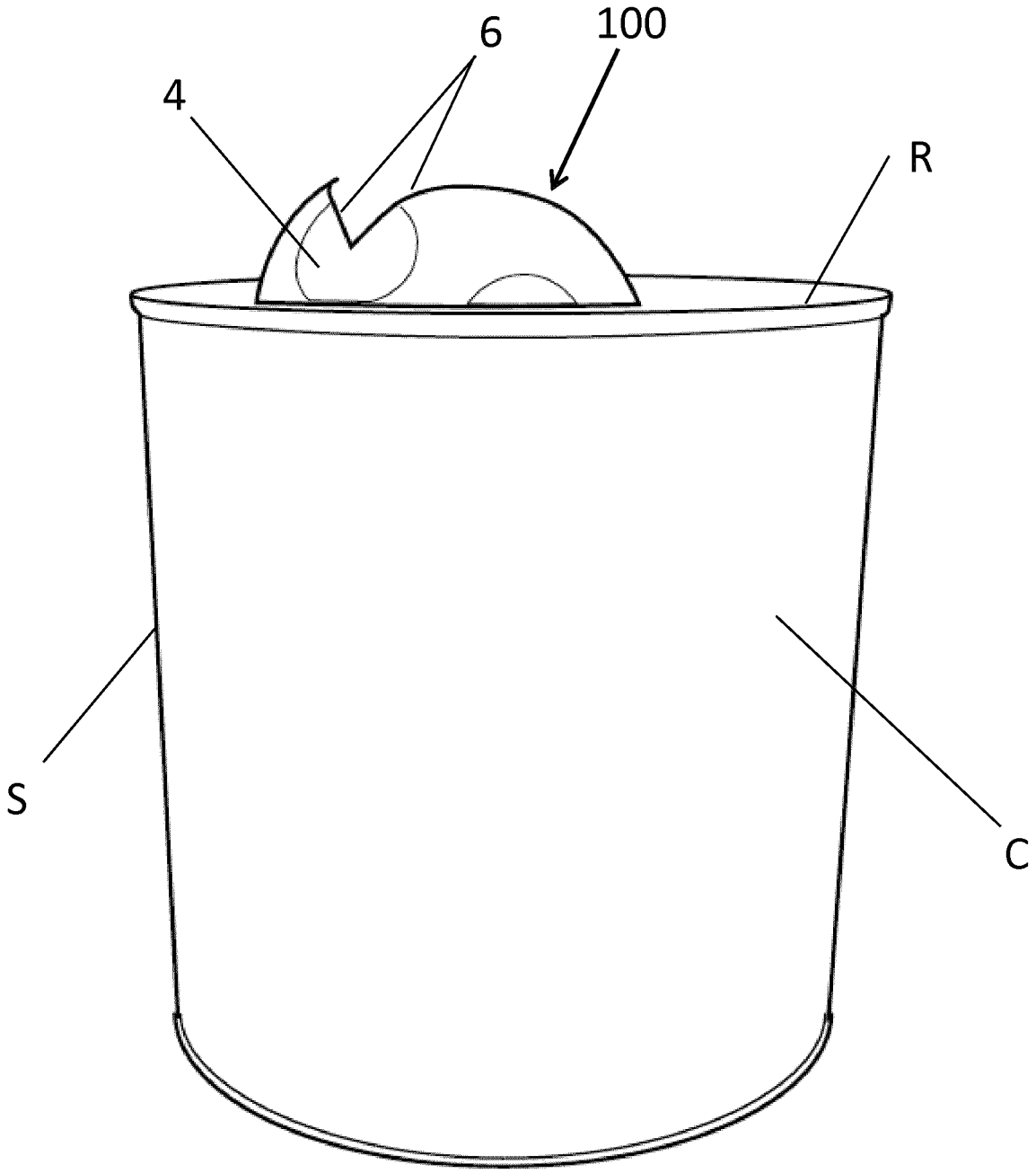
FIG. 5 illustrates a perspective view of the retractable spout device in use; fixed to a container and in the deployed position.
Figure 6:
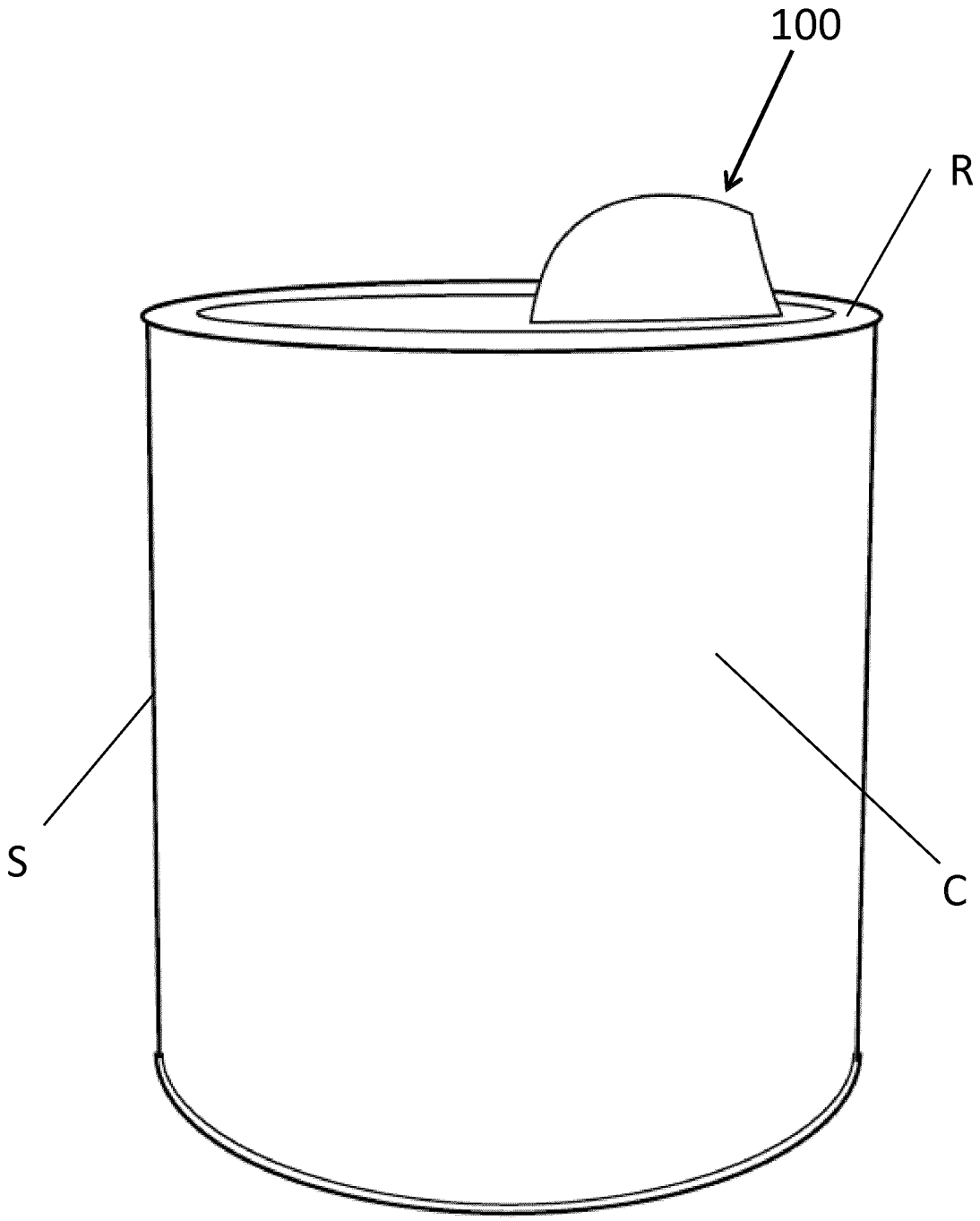
FIG. 6 illustrates an alternative perspective view of the retractable spout device as fixed to a container and in the deployed position.

As illustrated in FIG. 6, the spout is preferably inclined towards the radial centre of the container (C), relative to the interface between the first section (1) and the second section (2). This rearwardly angled form encourages the spout to collapse rearwardly into the container (C), regardless of the direction in which the lid (L) is applied. In a particularly preferred embodiment, to further encourage the displacement of the second section (2) back towards the collapsed position when a lid (L) is applied, at least a region of the second section (2) adjacent the pouring edge (6) may be arranged to curve rearwardly towards the radial centre of the container (C), as can be seen in FIG. 5.

Figure 4:
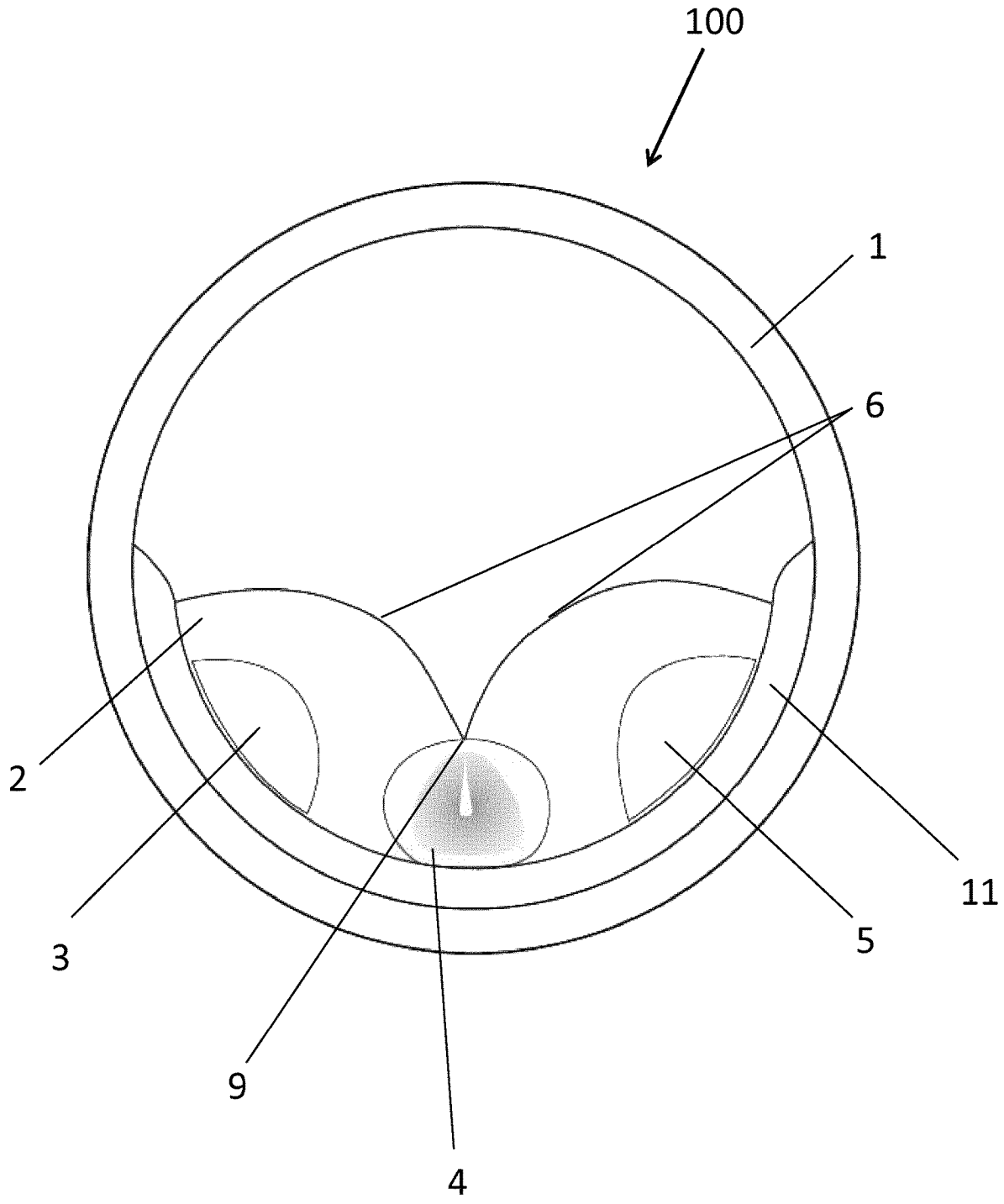
FIG. 4 illustrates a plan view of the retractable spout device in the collapsed position showing regions of increased flexibility.
Figure 8:
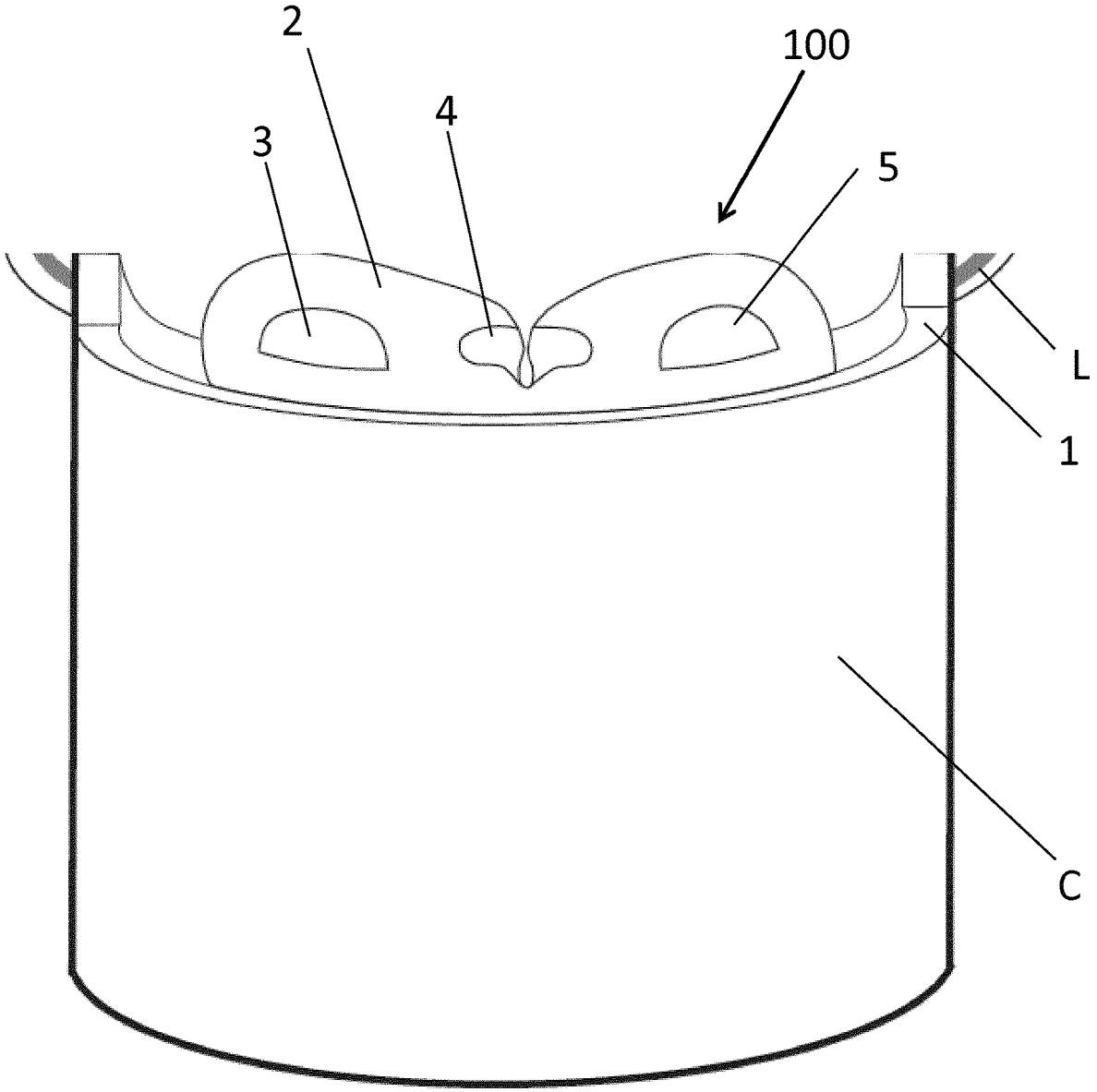
FIG. 8 illustrates a sectional view of the retractable spout device as fixed to a container and in the retracted position due to the presence of a lid on the container.

It will be appreciated that in the deployed position both the first section (1) and second section (2) adopt a concave shape which substantially corresponds to the curvature of the sidewall (S) of the can (C). However, when the second section (2) is drawn inwardly and downwardly towards the radial centre of the container (C) into the retracted position, the second section (2) deforms to adopt a much tighter concave curvature (taking the form of a somewhat collapsed concave structure), the flexibility of the second section (2) enabling this substantially collapsed curvature. The substantial collapse of the second section (2) in the retracted position can be controlled through introducing one or more regions of increased flexibility (3, 4, 5) thereby limiting deformation to specific areas whilst retaining the substantially concave structure of the remaining more rigid regions. In particular a centrally disposed region (4) of increased flexibility on the second section (2) allows the two sides of the spout to come together through the deformation of the central region (4) of increased flexibility. By locating at least the central region (4) of increased flexibility such as to extend to the pouring edge (6), as clearly shown in FIG. 2, the two halves of the second section (2) as defined on either side of the apex (9) can effectively be displaced towards one another into the collapsed state, as shown in FIG. 4 and FIG. 8. As this collapsing deformation occurs the central region (4) itself collapses downwardly into a funnel or cone, primarily due to the circular shape and central position of the central region (4) and as a result is not bunched or otherwise gathered about the rim (R) which could interfere with the proper closure/sealing of the lid (L) onto the container (C).

A pair of lateral regions (3, 5) of increased flexibility ensure that the opposed sides of the second section (2) can fully collapse downwardly from the deployed position. It will be appreciated that each of the regions (3, 4, 5) may be varied in shape, location and flexibility, depending on the overall shape, dimensions and materials of the spout device (100), once the above mentioned functionality is retained. In the preferred embodiment illustrated the lateral regions (2, 5) are substantially semi-circular in shape and extend into the second section (2) from at or adjacent the live hinge (7). Each lateral region (3, 5) is circumferentially spaced from the central region (4).

It is desired to avoid the pouring edges (6) of the opposed portions of the second section (2), on either side of the central region (4), from contacting each other as and when the second section (2) collapses, as in the presence of paint or other substance the pouring edges (6) could potentially adhere to one another and prevent the second section (2) from returning to the expanded state. The spout device (100) may therefore comprise a stiffened portion (13) within the central region (4), as shown only in FIGS. 2 and 3, which acts to limit the amount by which the central region (4) is collapsible, effectively acting to hold the opposed pouring edges (6) out of contact with one another when the second section (2) is displaced into the collapsed state. The stiffened region (13) may be achieved by increasing the thickness relative to the surrounding central region (4) and/or by utilising a different material to form the stiffened region (13). Again it will be appreciated that the exact position, shape and size of the stiffened region (13) may be varied as required in order to achieve the desired functionality.

Figure 9:
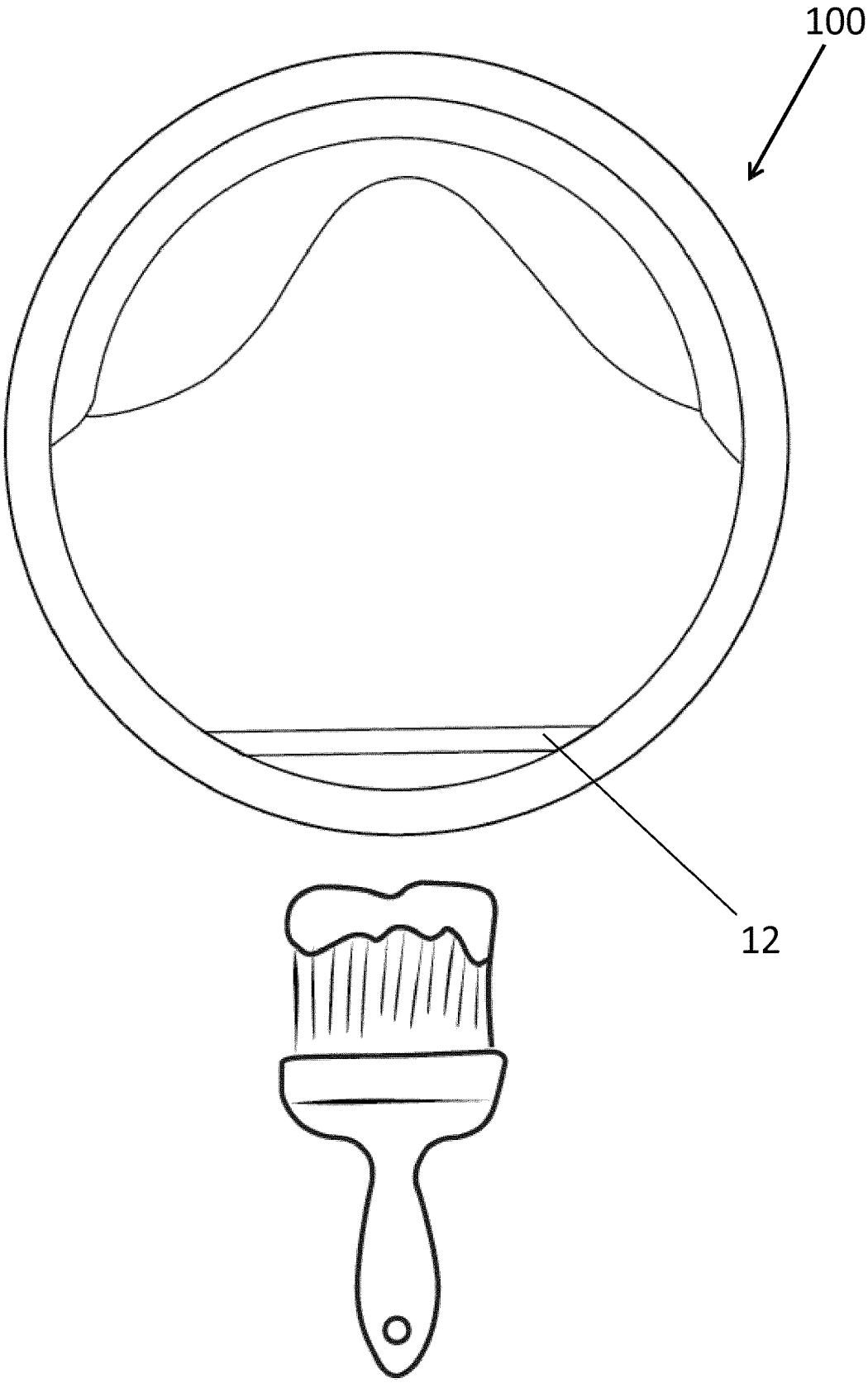
FIG. 9 illustrates a plan view of the spout retractable spout device of FIGS. 1 to 8 with an additional paint scraper feature included.

As illustrated in FIG. 9, the invention may include a rigid body or bar (12) which exposes at least one edge such that the exposed edge can be used to scrap excess paint off a paintbrush. This bar (12) can be incorporated as part of the first section (1) whether the first section (1) is an annual band or an arc or a segment.

It will thus be appreciated that the retractable spout device (100) of the present invention provides a simple and inexpensive spout which can be fitted to the can (C) as part of the manufacturing process or retrofitted on the can (C) after manufacture and which, when not in use, can be stored in the interior of the can (C) so as not to interfere with the normal storage, handling and cost of the can (C). The spout device (100) automatically assumes the deployed position once the lid of the container (C) is removed and is thus immediately ready for use without requiring any user input. Similarly the spout device (100) automatically collapses into the stored state once a lid is reapplied to the container (C).

The invention claimed is:

1. A retractable spout device for a flowable substance container comprising:

a first section adapted to be secured to an interior of the container, and a second section displaceable relative to the first section in order to facilitate the movement of the second section from a retracted position, wherein the second section is at least partially collapsed, to a deployed position, wherein the second section extends outwards to form a spout- and wherein the second section comprises at least one region of increased flexibility relative to the flexibility of the rest of the second section, and wherein the at least one region of increased flexibility is centrally disposed on the spout.

2. The device of claim 1 wherein the at least one region of increased flexibility extends to the pouring edge.

3. The device of claim 1 wherein the at least one region of increased flexibility is substantially circular.

4. The device of claim 1 wherein the at least one region of increase flexibility comprises a stiffened portion.

5. The device of claim 1 wherein the boundary between the first section and the second section is at least partially defined by a live hinge comprising a line of weakness.

6. The device of claim 1 wherein the second section comprises a recessed portion along a pouring edge comprising an apex.

7. The device of claim 6 wherein the pouring edge includes a protruding beak-like extension.

8. The device of claim 6 wherein the pouring edge of the second section is inclined towards the radial centre of the container, relative to the interface between the first section and the second section.

9. The device of claim 1 wherein the first section and second section are flexible.

10. The device of claim 1 wherein the second section has a shore hardness in the range of A50 to A100 and the first section has a shore hardness in the range of A5 to A50.

11. The device of claim 1 wherein the retractable spout device comprises multiple layers defining different physical characteristics.

12. The device of claim 1 wherein at least the outer surface of the second section is formed from a liquid repelling material.

13. The device of claim 1 wherein at least the outer surface of the second section is formed from a non-adherent material.

14. The device of claim 1 wherein at least one of the first section and the second section comprises rubber.

15. The device of claim 1 wherein the first section is of a substantially elongate rectangular shape.

16. The device of claim 1 wherein the second section is arranged, in use, to project beyond a mouth of the container when it is in the deployed position.

17. The device of claim 1 wherein the retractable spout device comprises a drainage channel as part of the first section such that, in use, any excess flowable substance which migrates from the second section to the first section is returned to the container.

18. The device of claim 17 wherein the drainage channel extends laterally beyond the second section.

19. The device of claim 1 wherein first section is adapted to be secured, in use, at any point on an interior surface of the container through means of an adhesive layer.

20. The device of claim 1 wherein the first section is dimensioned to provide, in use, an interference fit with an interior of a sidewall of the container.

21. The device of claim 1 further comprising a rigid body exposing at least one edge which is suitable for use as a paint brush scraper, wherein the rigid body is situated adjacent to the second section in order to form a geometric chord across the container.

22. The device of claim 1 wherein the first section is an annular band with an at least partial interface with the second section.

23. The device of claim 1 wherein the retractable spout device comprises a resilient spout which is displaceable between the deployed position and the collapsed position.

24. A flowable substance container comprising:

an interior sidewall;

a mouth; and a retractable spout;

the retractable spout comprising a first section adapted to be secured to an interior of the container, and a second section displaceable relative to the first section in order to facilitate the movement of the second section from a retracted position, wherein the second section is at least partially collapsed, to a deployed position, wherein the second section extends beyond the mouth to form a spout- and wherein the second section comprises at least one region of increased flexibility relative to the flexibility of the rest of the second section, and wherein the at least one region of increased flexibility is centrally disposed on the spout.

25. The container of claim 24, wherein the retractable spout is releasably secured to the interior sidewall.

26. The container of claim 24 wherein the retractable spout is wholly contained within the container when in the retracted position.

27. The container of claim 24 wherein the container comprises a removable or hinged cover to seal the mouth of the container, and wherein the retractable spout device is dimensioned to fit, in use, within the space enclosed by the container and the removable or hinged cover.

* * * * *